US005526010A

United States Patent [19]

Plunk

[11] Patent Number: 5,526,010

[45] Date of Patent: Jun. 11, 1996

[54] SUPPORT DEVICE FOR PORTABLE SATELLITE DISH

[76] Inventor: Richard L. Plunk, 104 Indian Hill, Willis, Tex. 77378

[21] Appl. No.: 385,783

[22] Filed: Feb. 9, 1995

[51] Int. Cl.[6] ..... H01Q 1/08; H01Q 3/02

[52] U.S. Cl. ..... 343/882; 343/880; 343/881; 248/910

[58] Field of Search ..... 343/882, 878, 343/880, 881, 890; 248/284.1, 291.1, 910; 52/27, 29, 37; H01Q 1/08, 3/02

[56] References Cited

U.S. PATENT DOCUMENTS 4,649,675 3/1987 Moldovan et al. ..... 248/910

4,922,264 5/1990 Fitzgerald et al. ..... 248/910

*Primary Examiner*—Hoanganh Le

*Attorney, Agent, or Firm*—Bush, Moseley, Riddle & Jackson

[57] ABSTRACT

A portable support stand for a small diameter satellite dish (10) supported by a mast (22), mounted for pivotal movement in a vertical plane about a lower support bracket (40). A lower support base comprises a pair of legs (54, 56) having parallel straight portions (58) and diverging extending portions (60) for supporting the stand on a horizontal surface in a free standing relation. A ballast such as a stepping stone (70) is positioned on the upper surface of legs (54, 56) generally at the junctures of straight portions (58) with diverging portions (60) to minimize any overturning of the stand. A vertical mounting bar (76) is provided alternatively for mounting the support stand on a vertical supporting surface.

19 Claims, 2 Drawing Sheets

FIG. 1
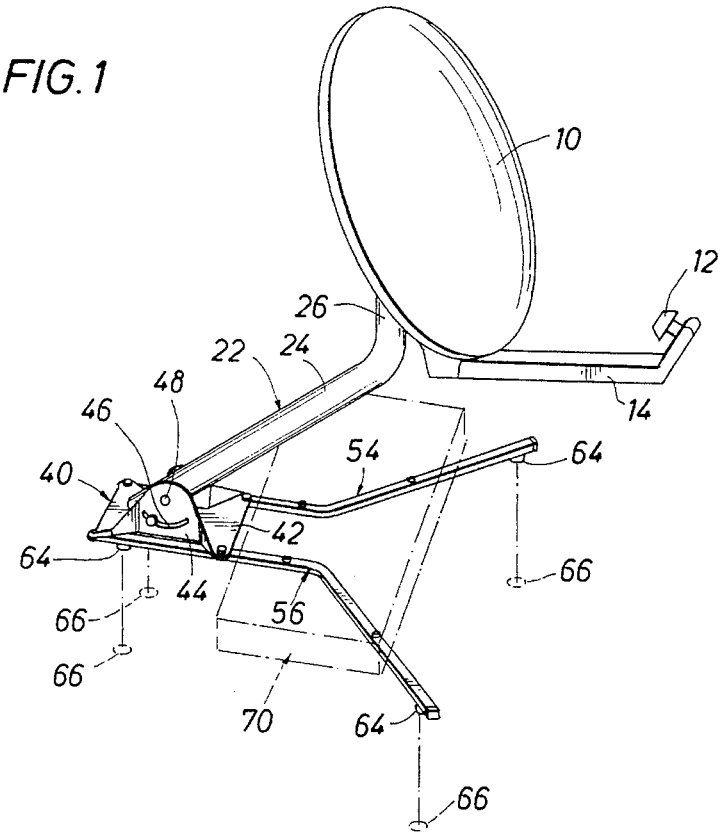
FIG. 2
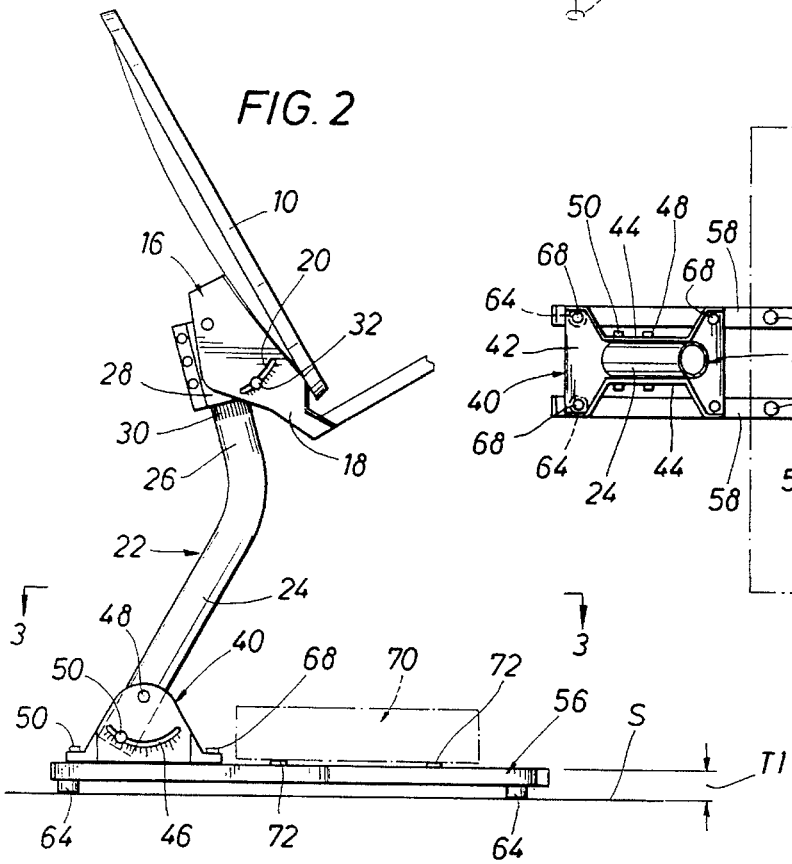
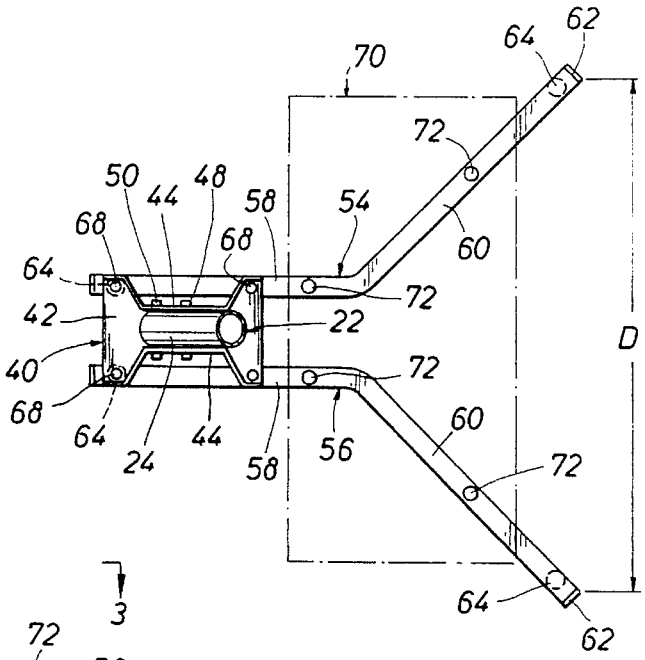
FIG. 3

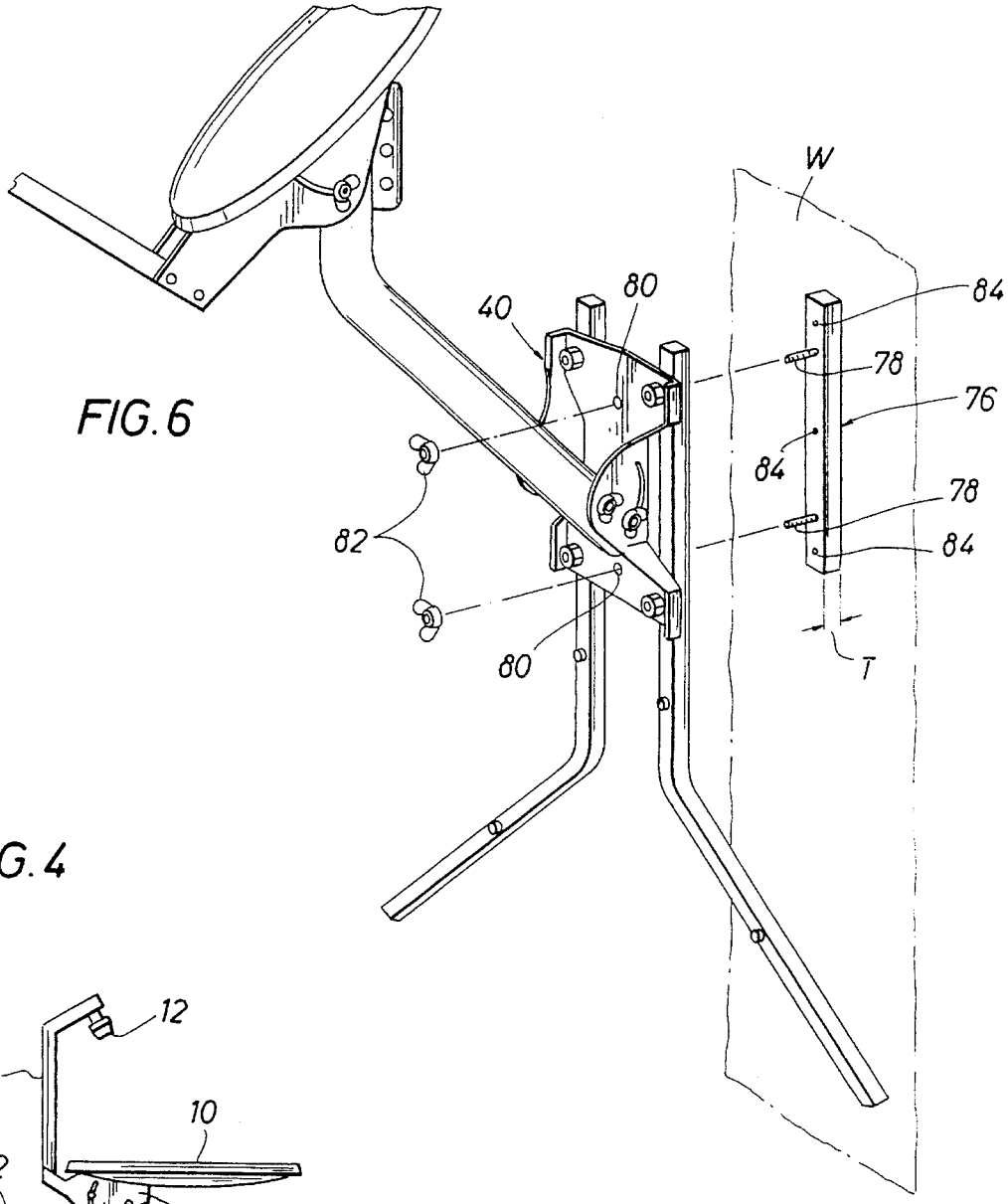
FIG. 6
FIG. 4
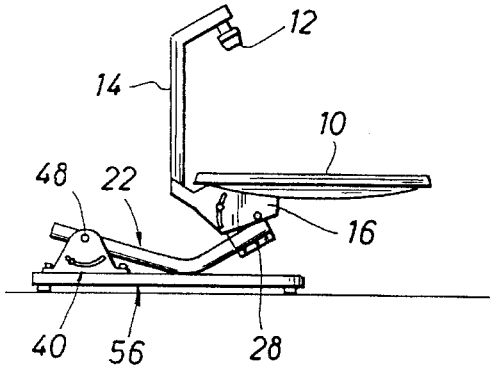
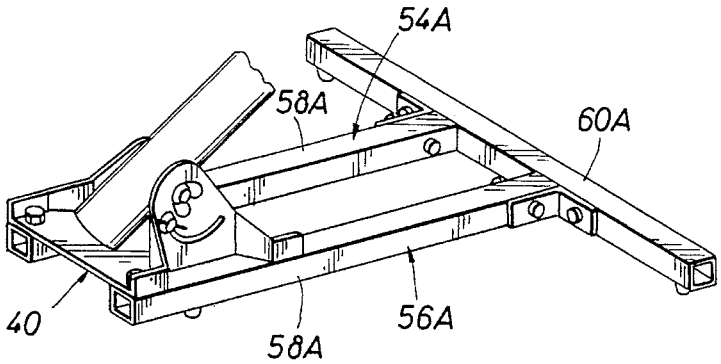
FIG. 5

SUPPORT DEVICE FOR PORTABLE SATELLITE DISH

FIELD OF THE INVENTION

This invention relates to a support device for a portable small diameter satellite dish, and more particularly to such a support device which may be easily moved with the satellite dish from one location to another location, and then repositioned at the original location.

BACKGROUND OF THE INVENTION

Small diameter satellite dishes less than around two (2) feet in diameter are being utilized today and these satellite dishes may be easily moved from one location to another location as the weight of such a satellite dish may be less than around fifteen (15) to twenty (20) pounds. The satellite dish is normally mounted on the extending end of a mast or metal post for rotation about a vertical axis. Graduations are positioned on the mast at the satellite dish in order to provide a compass to indicate the direction in which the satellite dish is pointing relative to "True North". The satellite dish is oriented upon anchoring of the lower end of the mast. Thus, the satellite dish may be turned to a precise direction.

Satellite dishes are normally fixed to a supporting surface, such as a concrete foundation or brick wall, for example. With a fixed supporting surface, the satellite dish may be easily oriented and maintained in a precise location. However, many apartment buildings or other rental units have restrictions against permanently mounting a satellite dish on the premises. Also, it may be desirable during travel on weekends or vacations that the satellite dish be transported particularly by recreational vehicles for use at the vacation site, and then returned to the home upon completion of the vacation. Thus, a portable satellite dish which may be easily moved and then repositioned at its original location in properly oriented position is highly desirable. A satellite dish may also be positioned inside an office or apartment adjacent a window as the signals penetrate glass, curtains, and plastic blinds.

SUMMARY OF THE INVENTION

The present invention is directed to a support device or stand for a satellite dish which is easily stabilized and oriented. The support stand is particularly adapted for use with a support mast or metal post having an extending end on which the satellite dish is mounted for relative rotation about a generally vertical axis for orientation, and for relative pivotal movement in a generally vertical plane about a horizontal axis. The lower end of the mast is mounted on a mounting bracket for limited pivotal movement in a generally vertical plane about a horizontal axis. The satellite dish is mounted on the extending free end of the mast and when pivoted to a downward position on the mounting bracket exerts a torque against the bracket tending to tilt the mounting bracket and associated base support. Thus, the base support and stand of this invention are particularly to counteract the torque exerted by the mast against the mounting bracket and stand.

The stand is particularly adapted for movement from one location to another location and includes a mounting bracket with a pair of horizontal support legs including inner ends beneath the bracket. The stand is portable and may be moved from one free standing location to another free standing location, or may be moved between a free standing location and a removably fixed relation. The support legs extend outwardly in a direction generally parallel to the longitudinal axis of the mast to a location generally beneath the satellite dish in a normal position, and then diverges outwardly away from the mast and satellite dish with the outer ends of the legs spaced from each other a distance substantially greater than the diameter of the satellite dish. The legs have feet which contact the supporting surface. The position of the feet on the supporting surface can be easily marked so that after transport of the portable satellite dish to another location, the satellite dish may be returned to its original location in an oriented position. To stabilize the base support, a ballast is positioned over the legs generally at the junctures of the outer diverging portions of the legs with the inner straight parallel portions. The ballast may comprise a sand bag or concrete block, for example. In this manner the portable satellite dish may be maintained in an oriented position on a supporting surface, such as a patio.

One embodiment includes a mounting bar for mounting the satellite dish on a vertical wall, if desired. Thus, the satellite dish may be easily moved between a free standing or unsecured horizontal support on the floor and a vertical support fixed to a wall or fence. The satellite dish is mounted on a post for relative pivotal movement along an arc of around ninety (90) degrees.

It is an object of this invention to provide a portable support stand for a small diameter satellite dish that can be easily transported from one location to another location.

Another object of this invention is to provide such a portable support stand for a small diameter satellite dish that is supported selectively between a free standing horizontal support on a floor and a fixed vertical support on a wall or the like.

It is a further object of the invention to provide such a portable support stand which can be easily stabilized by ballast.

An additional object of this invention is to provide such a portable support stand which, after transport to another location, can be easily returned to its original position with the satellite dish in an oriented position.

A further object is to provide a kit for the support base of the portable support stand including a pair of legs which may be easily assembled beneath a support bracket for the mast supporting the satellite dish for mounting the satellite dish on a horizontal support surface, and a support bar for mounting the satellite dish on a vertical supporting surface.

Other objects, features, and advantages of this application will be apparent from the following specification and drawings.

BRIEF DESCRIPTION OF THE DRAWINGS

FIG. 1 is a perspective of the present invention comprising a portable support stand for a satellite dish and mounted in a free standing relation;

FIG. 2 is a side elevation of the portable support stand shown in FIG. 1;

FIG. 3 is a section taken generally along line 3—3 of FIG. 2 and showing the support base for the mast including a lower support bracket and a pair of support legs in plan;

FIG. 4 is a perspective of the invention mounted on a support bar secured to a vertical wall with the mounting bar shown spaced from the stand prior to assembly;

FIG. 5 is an enlarged perspective of a portion of the stand secured to the mounting bar; and FIG. 6 is a side elevation of the stand and satellite dish in a position for transport between two locations.

DESCRIPTION OF THE INVENTION

Referring now to the drawings for a better understanding of this invention, the satellite dish assembly shown in FIGS. 1–3 comprises a parabolic reflector generally indicated at 10 and a low noise amplifier/block converter (LNB)/receiver 12 mounted forwardly of reflector 10 on a mounting bar 14. A suitable cable (not shown) is connected to LNB/receiver 12 and extends to a television set or telephone, for example. Parabolic reflector 10 and mounting bar 14 are fixed to an upper mounting bracket generally designated 16. Mounting bracket 16 is of a generally U-shape having a pair of spaced parallel arms 18 which have arcuate slots 20 therein.

A mast or metal post generally indicated at 22 has a lower portion 24 and an upper bent portion 26 which extends in a generally vertical position. Mounted for relative rotative movement on the free end of upper bent portion 26 is a sleeve generally indicated at 28. Graduations or indicia 30 on the exterior surface of upper mast portion 26 has degrees marked thereon so that bracket 28 may be rotated 360 degrees about mast portion 26 with the position of parabolic reflector 10 being oriented with respect to true north.

Mounting bracket 16 is mounted for relative pivotal movement in a vertical plane about horizontal pivot pin 32 which is mounted on sleeve 28 and graduations adjacent slot 20 indicate the amount of pivotal movement of parabolic reflector 10 in a vertical plane relative to mast 22. The pivotal movement of bracket 16 together with reflector 10 and receiver 12 is limited by pin 32 within arcuate slots 20. Sleeve 28 may be rotated 360 degrees about mast 22 as indicated. Thus, reflector 10 may be rotated 360 degrees relative to mast 22 and tilted around 45 degrees in a vertical plane relative to mast 22.

tower portion 24 of mast 22 is mounted for pivotal movement in a vertical plane on a lower support bracket generally indicated at 40. Lower support bracket 40 includes a lower horizontal plate 42 and a pair of parallel spaced vertical arms 44 having arcuate slots 46 therein. A horizontal pivot pin 48 extending between arms 44 through mast 22 mounts mast 22 on bracket 40 for relative pivotal movement over around ninety (90) degrees in a vertical plane. Suitable graduation or indicia are provided adjacent arcuate slot 46 to indicate the angular relationship of mast 22 relative to lower support bracket 40. A pin 50 mounted in arcuate slots 46 and secured to mast 22 for pivotal movement therewith limits pivotal movement of mast 22 in a vertical plane to around seventy-five (75) degrees.

A base support for mounting bracket 40 is an important feature of this invention and is particularly designed to provide stability for the portable stand and lower support bracket 40. The base support includes a pair of legs 54 and 56. Legs 54 and 56 include inner parallel straight portions 58 and diverging portion 60 which diverge outwardly around 45 degrees relative to straight portions 58. The ends 62 of diverging portion 60 are spaced from each other a distance D greater than the diameter of parabolic reflector 10 and extending in a longitudinal direction horizontally beyond parabolic deflector 10. Legs 54 and 56 are adapted to be supported on a level floor or supporting surface S which is normally formed of concrete, brick, or wood, for example. Each leg 54, 56 has a pair of lower support pads 64 thereon preferably formed of a hard synthetic rubber type material having a high drag coefficient to reduce skidding or sliding along supporting surface S as may result from various weather conditions, such as high wind conditions. Lower support pads or feet 64 are of a circular configuration and provided adjacent the ends of legs 54, 56 to permit marks 66 as shown in FIG. 1 to be made on supporting surface 5 to indicate the position of pads 64. In the event the portable stand is removed, the portable stand may be returned to its original position with pads 64 positioned on marks 66. Thus, pads 64 are positioned in a directionally polarized configuration to provide a pattern of marks indicating the original position for replacement of the disk. Lower plate 42 of bracket 40 is bolted by bolts 68 to legs 54 and 56.

To stabilize the support stand, ballast illustrated as a concrete block or stepping stone 70 is positioned on the upper surface of legs 54 and 56 generally at the junctures of straight leg portions 58 and diverging leg portions 60. Upper pads 72 on the upper surface of legs 54 and 56 are adapted to contact the lower surface of stepping stone 70 to minimize movement of stepping stone 70. Upper pads 72 are formed of a high friction elastomeric material. While ballast has been illustrated in the drawings as a stepping stone 70, it is to be understood that other types of ballast may be employed satisfactorily, such as a pan filled with sand or water, a sand bag, a plastic water jug, a planter in which soil and flowers are positioned, or other similar devices having a weight of over around 20 pounds.

FIG. 4 shows the satellite dish assembly collapses for transport. Pin 50 is removed from mast 22 and mast 22 is then folded downwardly against lets 54, 56 as shown.

Referring to FIG. 5, modified legs 54A and 56A are illustrated including straight leg portions 58A connected by an end transverse portion 60A of a length to extend outwardly from leg portions 58A to stabilize the stand. Mounting bracket 40 is mounted on legs 54A and 56A in a manner similar to legs 54 shown in FIGS. 1–3.

If desired, mast 22 could be increased in length by the addition of an additional section to the upper end of mast 22. Also, particularly when uneven supporting surfaces S are provided, it may be desirable to utilize a level, such as a bubble-type level on leg 54 or 56. Further, support pads 64 could be made adjustable in height to provide for leveling of legs 54 and 56. Legs 54, 56 could also be formed of different shapes with diverging portions extending at right angles to the straight parallel portions so as to provide the desired stability. Satellite dish 10 may be of a diameter between around 15 inches and 24 inches and of a weight from 5 to 15 pounds, for example. Particularly when parabolic reflector 10 is rotated 90 degrees from the position shown in FIGS. 1 and 2, an overturning torque may be provided which is resisted by the weight of ballast or stepping stone 70 on legs 54, 56.

Satellite dish or reflector 10 may also be positioned within an office or apartment adjacent a south window as the signals penetrate glass, fabric, and plastic blinds. In some instances it may be desirable to removably mount the satellite dish on a vertical support surface, such as a vertical wall, fence, or side of a recreational vehicle, for example. FIG. 6 shows an arrangement in which the embodiment of FIGS. 1–3 may be removably mounted on a vertical supporting surface or alternatively on a horizontal surface such as a deck or a pitched surface, such as a roof, and quickly connected to and disconnected from the supporting surface. For this purpose a kit for mounting bracket 40 may be provided including legs 54, 56 and a vertical support bar 76 having fixed mounting studs 78 which are externally threaded. Mounting bracket 40 has openings 80 to receive studs 78 and suitable wing nuts 82 are threaded on studs 78 for removably connecting satellite dish 10 to a vertical supporting surface. Suitable fasteners 84, such as screws or lag bolts, for example, secure bar 76 to the vertical supporting surface W which may by of wood or plaster board, for example. The projecting thickness T of vertical support bar 76 is slightly less than the projecting height or thickness T1 of legs 54 and 56 as shown in FIGS. 2 and 6 so that pads 64 on legs 54, 56 are in contact with supporting surface W when satellite dish 10 is mounted on vertical support bar 76 as shown in FIG. 6.

While wing nuts 82 are shown in FIG. 6 to removably mount the satellite dish assembly shown in FIGS. 1–3 on vertical support bar 76, a quick disconnect may be utilized instead of wing nuts 82. Such a quick disconnect may include an overcenter clamp on an elongated portion (not shown) of support bar 76 which extends beyond straight portions 58. The clamp when pivoted in one direction would engage straight portion 58 to clamp legs 54, 56 and bracket 40 against vertical support bar 76 with studs 78 received with openings 80 of bracket 40. The clamp when pivoted in an opposite direction would release legs 54 and 56.

Since certain changes or modifications may be made in the disclosed embodiment without departing from the inventive concepts involved, it is the aim of the appended claims to cover all such changes and modifications falling within the true spirit and scope of the present invention.

What is claimed is:

1. A portable mounting device for a relatively small diameter satellite dish less than around two feet in diameter, said mounting device comprising:

a mast on which said dish is mounted for relative rotation about a generally vertical axis and for relative pivotal movement about a generally horizontal axis in a vertical plane;

a bracket mounting the lower end of said mast for limited pivotal movement in a vertical plane about a generally horizontal axis, said bracket including a generally flat horizontal plate and a pair of spaced generally parallel vertically extending arms supporting said lower end for pivotal movement;

a pair of spaced legs beneath said flat horizontal plate, each having an inner end portion secured to said plate and extending outwardly therefrom in a direction beneath said satellite dish, each of said legs having an extending outer end portion angling laterally outwardly away from the inner end portion thereof and extending beyond said satellite dish; said inner and outer end portions of each leg having a juncture generally beneath a portion of said satellite dish; and ballast positioned over said legs generally at the juncture of said inner end portions and said outer end portions for maintaining said portable mounting device in a predetermined location on a supporting surface.

2. A portable mounting device for a satellite dish as set forth in claim 1 wherein said legs comprise separate members each separately secured to said bracket.

3. A portable mounting device for a satellite dish as set forth in claim 2 wherein each leg has a pair of spaced supporting pads projecting downwardly from the lower surface of the associated leg for contacting the supporting surface for the satellite dish, said pads being positioned generally adjacent the ends of said legs.

4. A portable mounting device for a satellite dish as set forth in claim 3 wherein said pads are formed of a material to provide a resistance to skidding of the mounting device along a supporting surface.

5. A portable mounting device as set forth in claim 4 wherein said pads form a directionally polarized pattern so that the position of said pads on the supporting surface may be easily marked for repositioning in the event the portable mounting device is moved to another position.

6. A portable mounting device as set forth in claim 1 wherein said legs have a plurality of non-skid members extending from the upper surface of said legs for contacting said ballast upon positioning of said ballast on said legs.

7. A portable mounting device as set forth in claim 6 wherein said non-skid members are formed of an elastomeric material providing high frictional contact with the ballast thereon to minimize movement of the ballast.

8. A portable supporting device as set forth in claim 1 wherein said ballast comprises a masonry block.

9. For use with a multi-purpose portable mounting device for a relatively small diameter satellite dish less than around two feet in diameter having an inclined mast mounting the satellite dish on an upper end for rotative movement and a bracket mounting the lower end of the mast for pivotal movement in a vertical plane about a horizontal axis;

a bracket support comprising a pair of separate horizontal extending integral legs positioned beneath said bracket and secured at the inner ends of the legs to said bracket, said legs extending outwardly from said bracket in a generally parallel spaced relation to each other and then diverging outwardly from each other at junctures located generally beneath said satellite dish with the outer ends of said legs spaced from each other a distance greater than the diameter of said satellite dish whereby said legs are adapted to support ballast thereon generally in the area of the junctures of said legs for stabilizing said satellite dish;

each of said legs having pads extending downwardly from the lower surface of the associated legs for contacting a supporting surface for the satellite dish.

10. A bracket support for use with a multi-purpose portable mounting device for a satellite dish as set forth in claim 9 wherein ballast is positioned on said legs over the juncture thereof.

11. A bracket support for use with a multi-purpose portable mounting device for a satellite dish as set forth in claim 10 wherein:

said pads are formed of a material to provide resistance to skidding of the mounting device along the supporting surface.

12. A bracket support for use with a multi-purpose portable mounting device for a satellite dish as set forth in claim 11 wherein:

said pads have a circular outer configuration so that the position of said pads on the supporting surface may be easily marked for repositioning in the event the portable mounting device is moved to another position.

13. A bracket support for use with a multi-purpose portable mounting device for a satellite dish as set forth in claim 12 wherein:

said legs have a plurality of anti-skid members extending from the upper surface thereof adjacent said junctures for contacting said ballast upon positioning of said ballast on said legs.

14. A bracket support for use with a multi-purpose portable mounting device for a satellite dish as set forth in claim 13 wherein:

said anti-skid members are formed of an elastomeric material providing high frictional contact with the ballast thereon to minimize movement of the ballast.

15. A portable satellite dish assembly operably arranged for transport between a horizontal supporting surface and a non-horizontal supporting surface, the satellite dish assembly being in a free standing position on the horizontal supporting surface and a removably secured position on the non-horizontal supporting surface; said portable satellite dish assembly comprising:

a relatively small diameter satellite dish less than around two feet in diameter;

a mast on which said dish is mounted for relative rotation about a generally vertical axis and for relative pivotal movement about a generally horizontal axis in a vertical plane;

a bracket mounting the lower end of said mast for limited pivotal movement in a vertical plane about a generally horizontal axis, said bracket including a generally flat horizontal plate and a pair of spaced generally parallel vertically extending arms supporting said lower end for pivotal movement;

a pair of spaced legs beneath said flat horizontal plate each having an inner end portion secured to said plate and extending outwardly therefrom in a direction beneath said satellite dish, each of said legs having an extending end portion angling laterally outwardly away from the inner end portion thereof and extending beyond said satellite dish; said legs arranged for supporting said assembly in a free standing position on the horizontal supporting surface; and a mounting bar secured to said non-horizontal supporting surface; said bracket arranged for supporting said assembly in a removably fixed position on said mounting bar.

16. A portable satellite dish assembly as set forth in claim 15 wherein a pair of externally threaded studs project outwardly from said mounting bar; said flat plate of said bracket having a pair of openings therein for receiving said externally threaded studs to position said assembly on said mounting bar.

17. A portable satellite dish assembly as set forth in claim 16 wherein each of said legs has pads extending downwardly from the lower surface of the associated legs for contacting the horizontal supporting surface in said free standing relation, and means securing said flat plate of said bracket on said externally threaded studs with said pads on said legs contacting said supporting surface.

18. For use with a portable mounting device for transport of relatively small diameter satellite dish less than around two feet in diameter between a horizontal supporting surface and a vertical supporting surface, the mounting device being in a free standing position on a horizontal supporting surface and a removably secured position on the vertical supporting surface and having an inclined mast mounting the satellite dish on an upper end for rotative movement and a bracket mounting the lower end of the mast for pivotal movement in a vertical plane about a horizontal axis;

a bracket support comprising a pair of separate horizontal extending integral legs positioned beneath said bracket and secured at the inner ends of the legs to said bracket, said legs extending outwardly from said bracket in a generally parallel spaced relation to each other and then diverging outwardly from each other at junctures located generally beneath said satellite dish with the outer ends of said legs spaced from each other a distance greater than the diameter of said satellite dish whereby said legs are adapted to support ballast thereon generally in the area of the junctures of said legs for stabilizing said satellite dish; and an elongate mounting bar operably arranged for securement to a vertical supporting surface for releasably mounting said bracket and satellite dish thereon.

19. For use with a portable mounting device as set forth in claim 18 wherein a pair of externally threaded studs project outwardly from said elongate mounting bar and are operably arranged to be received within a pair of cooperating openings in said bracket for releasable securement.

* * * * *